US010984973B2

(12) United States Patent
Sikorski et al.

(10) Patent No.: US 10,984,973 B2
(45) Date of Patent: Apr. 20, 2021

(54) ELECTRIC SWITCH PROVIDED WITH AN ARC-BLASTING UNIT

(71) Applicant: GENERAL ELECTRIC TECHNOLOGY GMBH, Baden (CH)

(72) Inventors: Thomas Sikorski, Basel (CH); Boris Nechal, Aarwangen (CH); Robert Luescher, Seon (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 16/635,386

(22) PCT Filed: Jul. 31, 2017

(86) PCT No.: PCT/EP2017/069350
§ 371 (c)(1),
(2) Date: Jan. 30, 2020

(87) PCT Pub. No.: WO2019/024978
PCT Pub. Date: Feb. 7, 2019

(65) Prior Publication Data

US 2020/0161066 A1 May 21, 2020

(51) Int. Cl.
*H01H 33/02* (2006.01)
*H01H 33/74* (2006.01)
(Continued)

(52) U.S. Cl.
CPC ..... *H01H 33/91* (2013.01); *H01H 33/74* (2013.01); *H01H 33/022* (2013.01); *H01H 2033/906* (2013.01); *H01H 2033/908* (2013.01)

(58) Field of Classification Search
CPC ..... H01H 33/74; H01H 33/86; H01H 33/904; H01H 33/91; H01H 33/905; H01H 33/72;
(Continued)

(56) References Cited

U.S. PATENT DOCUMENTS 2,284,840 A 6/1942 William
3,940,583 A 2/1976 Hertz
(Continued)

FOREIGN PATENT DOCUMENTS

DE 2108871 A1 8/1972
DE 29716152 U1 10/1997
(Continued)

OTHER PUBLICATIONS

International Search Report of PCT/EP2017/069350 dated Apr. 19, 2018.
(Continued)

*Primary Examiner* — William A Bolton
(74) *Attorney, Agent, or Firm* — Eversheds Sutherland (US) LLP

(57) ABSTRACT

Embodiments of the disclosure relate to an electric switching unit provided with an arc-blasting unit. In one embodiment, an electric switch can be provided. This electric switch can include an arc-blasting unit with a compression cylinder enclosing a compression chamber mobile together with the mobile contacts, and a stationary piston at an end of the compression chamber, provided with a support rod made up as a blowpipe which channels the gas compressed in the chamber when the contacts separate to a nozzle that directs the flow to a separation place of the contacts so as to efficiently blast electric arcs. The arrangement can be relatively lightweight and can occupy relatively little space.

13 Claims, 3 Drawing Sheets

(51) Int. Cl.
*H01H 33/91* (2006.01)
*H01H 33/90* (2006.01)

(58) Field of Classification Search
CPC ..... H01H 33/022; H01H 2033/906; H01H 2033/908; H01H 1/385
USPC ... 218/52, 53, 55, 57, 60, 61, 63, 66, 79, 80
See application file for complete search history.

(56) References Cited

U.S. PATENT DOCUMENTS 4,046,979 A 9/1977 Hertz et al.
4,114,004 A * 9/1978 Dayet ..... H01H 33/12 218/59
4,780,581 A * 10/1988 Holmgren ..... H01H 33/901 218/59
5,179,257 A * 1/1993 Dufournet ..... H01H 33/98 218/62
5,978,200 A * 11/1999 Konma ..... H01H 33/91 218/157
6,646,850 B1 * 11/2003 Bergmann ..... H01H 33/7015 218/53
8,546,716 B2 * 10/2013 Nufer ..... H01H 33/901 218/43
2010/0193474 A1 8/2010 Rostron et al.

FOREIGN PATENT DOCUMENTS

EP 0 503 223 A2 9/1992
EP 0 744 759 A1 11/1996

OTHER PUBLICATIONS

Extended Search Report issued in European Patent Application No. 16179999.4, dated Nov. 16, 2016, 6 pages.

* cited by examiner

ELECTRIC SWITCH PROVIDED WITH AN ARC-BLASTING UNIT

RELATED APPLICATION

The present application claims priority to International Application No. PCT/EP2017/069350, titled "Electric Switch Provided with an Arc-Blasting Unit", filed Jul. 31, 2017, the contents of which are hereby incorporated by reference.

The present invention relates to an electric switching unit provided with an arc-blasting unit.

It may find use particularly, but not exclusively, in earthing switches for medium or high voltages, located in enclosures which may or not be filled by an insulating gas like SF6.

When the contacts of switches are disconnected at such voltages, an electric arc tends to appear and opposes the cutoff of the electric current. The arcs may remain permanent even when the contacts are fully separated apart, and their spontaneous extinction occurs randomly. They are less likely to appear when the contacts are immersed in an insulating fluid, but the gas-impervious enclosures that must be provided for enclosing the contacts are more expensive, and caution must be taken against leaks of the fluid, especially for the usual SF6 gas, which is toxic and deleterious to the environment. It must be remarked that this otherwise efficient gas has been less and less used over the recent years because of these drawbacks, and switches working without SF6 as an insulating gas, i.e., with mixtures of gases of low environmental impact, are becoming more widespread.

The arcs extinguish more often when the contacts are separated at high speed, and their gap at the open position of the switch is greater, but the extinction will nevertheless not be certain.

Systems for actively blasting the arcs with a gas flow are thus frequent in electric switches. They typically comprise a chamber aside from the cavity containing the contacts, in which the gas is compressed during the separation of the contacts by the displacement of a piston connected to the mobile contact. When a pressure buildup has been obtained, a valve opens and releases the compressed gas out of the chamber. The gas is blown into the cavity and blasts the arc.

The arc-blasting unit of the invention is based on a new system in which a gas flow extinguishing the arcs is created during the separation of the contacts. Owing to original characteristics, its structure can be made compact, and a high extinguishing efficiency of the gas flow is observed. Finally, the invention dampens the movements of the contacts at the end of their opening and closing stroke, respectively.

According to a general definition of the invention, it concerns an electric switch comprising: at least one fixed contact; at least one mobile contact sliding in front of the fixed contact in a movement direction between a closed position at which it is joined with the fixed contact and an open position at which it is separated from the fixed contact; characterized in that it comprises: at least one fixed blowpipe parallel to the movement direction, the blowpipe comprising a nozzle at the front end, the nozzle being directed towards a place at which the mobile contact separates from the fixed contact, and a piston at the rear end; a mobile enclosure connected to the mobile contact and sliding around the blowpipe and around the piston, a compression chamber, which communicates with the nozzle, being defined by the enclosure, the piston, and the blowpipe.

The most remarkable characteristic of this arrangement is that the piston is stationary now, but the enclosure surrounding it is mobile. The conventional piston rod is converted into the blowpipe, which can direct the gas flow accurately and in a concentrated beam to the even place where the arc appears, so that a much greater part of the flow energy is actually used to blast the arc, without allowing the flow to spread prematurely in the contacts cavity like in known arrangements.

The compression chamber may advantageously be provided with one or more valves being best present on the piston that opens at a negative pressure of advantageously less than one bar inside the compression chamber. That enables an easier filling of the chamber, thus less effort on the driving system, when the switch returns to the closed position and no gas flow through the blowpipe takes place.

According to another advantageous characteristic of the invention, the piston may have an elongated shape, and the enclosure, a corresponding elongated cross-section. This shape or section may be rectangular. A greater compactness may be obtained then; this is true especially for multiple phase switches in which a plurality of pairs of contacts is present, the mobile contacts being arranged in a row: the enclosure may extend with a flat shape just above the row of mobile contacts, as wide as the row but with a reduced height for a same volume of compressed gas. Also, a single enclosure and a single piston are preferred even for such multiphase switches despite a plurality of blowpipes may be present, each associated to a respective pair of contacts: the gas compressed in the enclosure is shared between the blowpipes, and the arrangement remains simple because only a single enclosure needs to be moved.

This simplicity of arrangement is further enhanced if the enclosure is fastened to the carriage that also displaces the mobile contacts. Also, a good compactness may be reached if the enclosure and the blowpipe are both arranged with overlaps with the mobile contact along the movement direction.

These and other aspects, characteristics, and advantages of the invention will now be exposed in greater detail with the comment of the following figures, which disclose a particular embodiment of the invention in a purely illustrative way:

Figure 3:
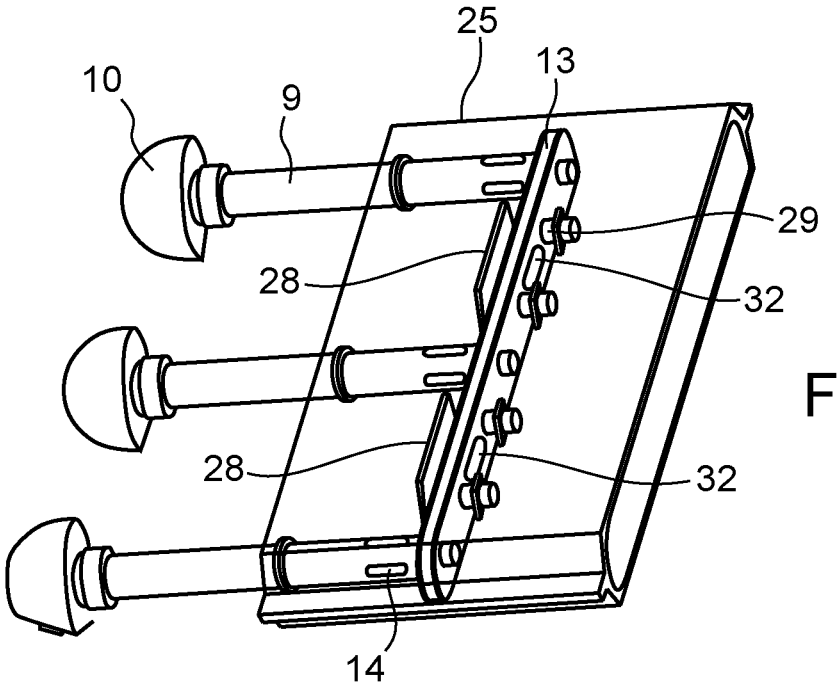
Figure 4:
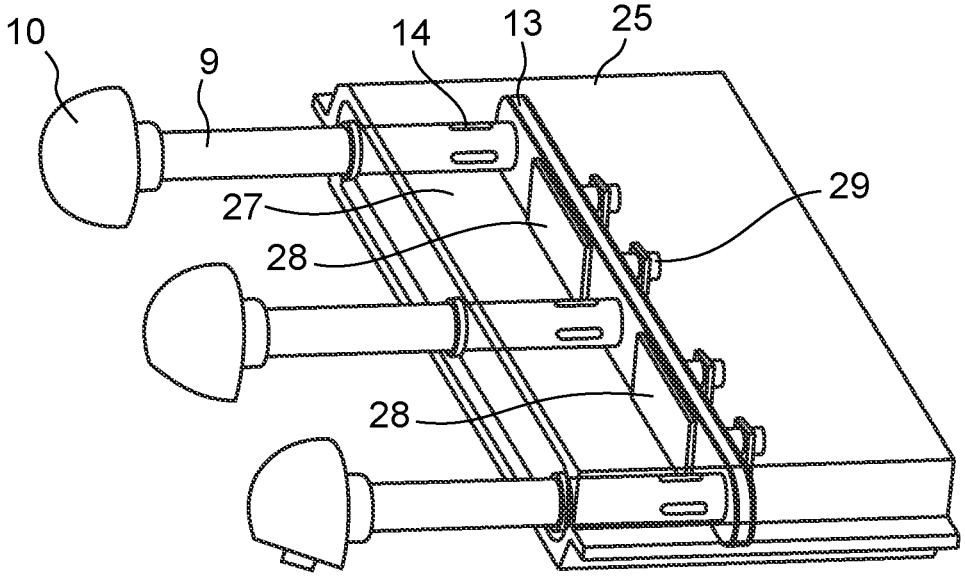

FIG. 3 particularly shows the inside of the compression system during a closing operation with open valves; and FIG. 4 shows the compression system again, but in an opening operation with closed valves.

Figure 1:
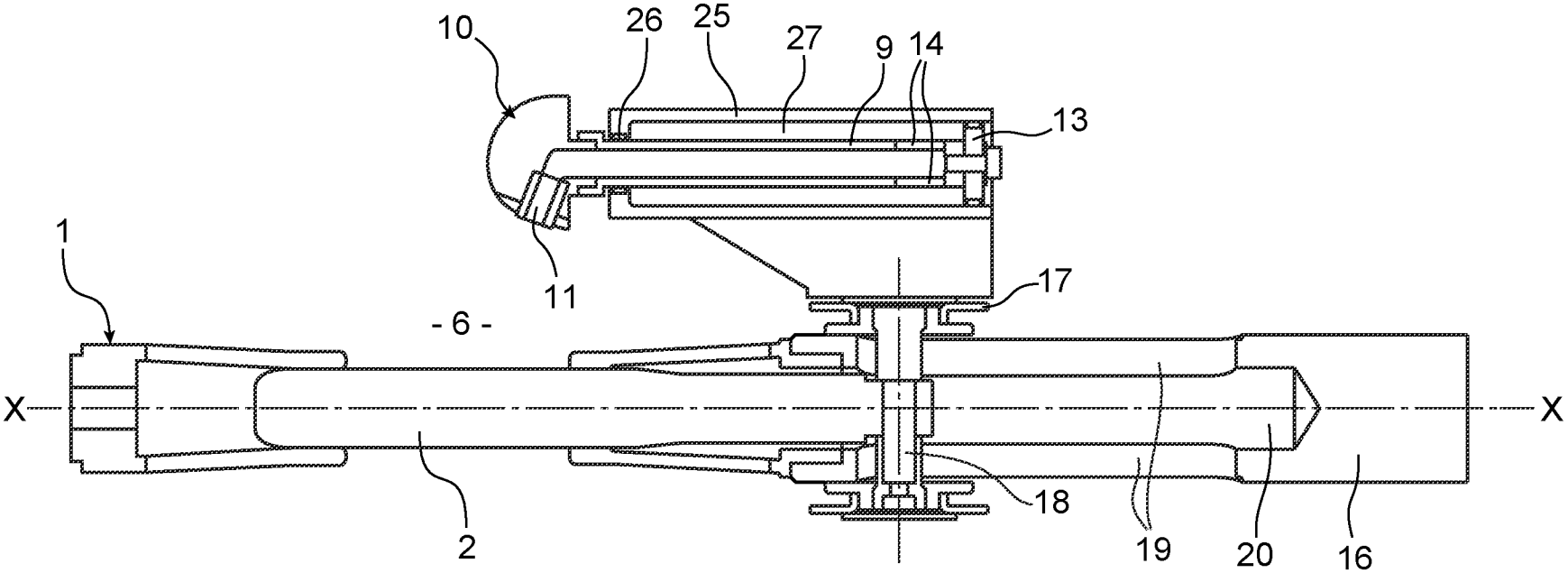
FIG. 1 shows a cutaway view through one pair of contacts with corresponding blowpipe, the switch being at the closed position.
Figure 2:
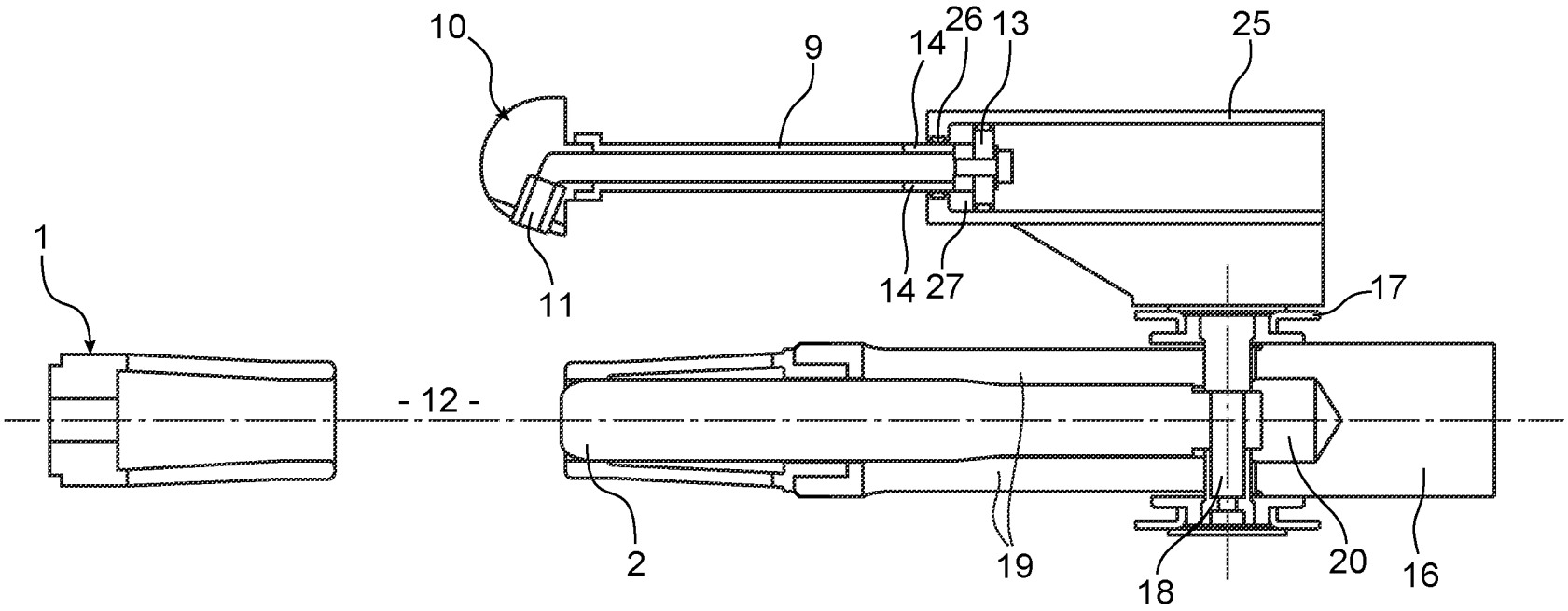
FIG. 2 shows the same view for the open position of the switch.

FIGS. 1 and 2 partly illustrate an earthing switch comprising at least one pair of contacts comprising a fixed contact 1 and a mobile contact 2, a front end of which can penetrate into the fixed contact 1.

The mobile contact 2 is reversibly moved in a movement direction X-X (FIG. 1). The invention can be implemented independently on the number, kind, and layout of contact pairs. For instance, the switch can be three-phase, and the fixed and mobile contacts are aligned in straight rows perpendicular to the movement direction X-X.

The arrangement also comprises blowpipes 9 located aside the pairs of fixed contacts 1 and mobile contacts 2. Front ends of the blowpipes 9 are equipped with nozzles 10.

The figures show that the blowpipes 9 are straight, continuously hollow tubes, and the nozzles 10 are provided with a curved or elbowed drilling 11 that is directed towards places 12 at which the mobile contacts 2 separate from the fixed contact 1 and electric arcs will thus be present. The blowpipes 9 are in the same number as the pairs of fixed and mobile contacts, are also arranged in a straight row, and extend at a short distance above respective ones of the mobile contacts. Rear ends of the blowpipes 9 are connected to a piston 13, which is common to all the blowpipes 9, as illustrated by FIGS. 3 and 4. The walls of the blowpipes 9 have openings 14 just before the piston 13.

The mobile contacts 2 slides in mobile contact tulips 15. The mobile contact tulips 15 are supported by tubular contact units 16 in the extension of the mobile contacts 2. A carriage 17 is supported by the contact units 16 and slides on them. It comprises axes 18, which are articulated to rear parts of the mobile contacts 2 and extend through the contact units 16 through longitudinal slots 19 machined at the upper and lower surfaces of the contact units 16. The switch operation consists in movements of the carriage 17, displacing the axes 18 between opposite ends of the slots 19 and the mobile contacts 2 between the closed position of the contacts of FIG. 1, in which the mobile contacts 2 extend in the front cavity 6, and the open position of FIG. 2, in which the mobile contacts 2 are completely retracted into the mobile contact tulips 15 and central bores 20 of the contact units 16. The carriage 17 is displaced by a driving mechanism An enclosure in the shape of a compression cylinder 25 is fastened to the carriage 17 and displaced with it. It comprises openings 26 at the front face, through which the blowpipes 9 extend. The piston 13 is contained in the compression cylinder 25. The piston 13 has an elongated rectangular shape, and the compression cylinder 25 a similarly elongated rectangular cross-section, so that they extend over the entire width of the row of mobile contacts but with a reduced height and can thus be accommodated easily in usual housings. Seals are provided at the openings 26 and around the piston 13 so that a compression chamber 27 defined by the compression cylinder 25 and the piston 13 generally communicates with the outside only through the nozzles 10. However, valves 28 are present on the piston 13. They are generally closed by sets of compression springs 29, but are able to open slots 32, and establish a supplementary communication of the compression chamber 27 with the outside, when a threshold of negative pressure is reached in the compression chamber 27.

When the switch must open, the carriage 17 is slid rearwards, the mobile contacts 2 separate from the fixed contact tulips 1, and an electric arc appears between them at the separation places 12. The compression cylinder 25 is slid on the blowpipes 9, and the compression chamber 27 shrinks. The gas contained therein is compressed and flows outside at the nozzles 10, which deflect it towards the separation places 12. The flows remain concentrated in thin beams directed precisely by the nozzles 10. Most of the blast energy therefore contributes to the arc extinction, in contrast with known devices in which the gas flow would be spread in the front cavity 6 comprising the contacts so that the overall efficiency would be lower. The valves 28 remain closed.

And when the switch returns to the closed state, a reverse movement is made, and the compression chamber 27 expands. A negative pressure buildup appears inside so that the valves 28 open by uncovering slots 32 punched through the piston 13 for facilitating a gas ingress into the compression chamber 27 until the pressure has increased at a degree allowing the springs sets 29 to bring the valves 28 back on the piston 13.

An originality of the invention is that the piston 13 is stationary but the enclosure surrounding it, the compression cylinder 25, is mobile, in contrast to known devices in which a piston depends on the mobile contacts and the enclosure in which the piston slides is a part of the housing or another stationary structure. The inventive arrangement enables a compact layout in which the piston 13 and compression cylinder 25 are not a longitudinal extension of the mobile contacts but are located aside them. The driving mechanism is simple and lightweight, the compression cylinder 25 and the mobile contacts being moved together by the same mechanism (the carriage 17). The piston rods, the blowpipes 9, can be made up with bores for channeling the gas flow and directing it accurately towards the even places, the separation places 12, where it is needed. Also, the pressure variations in the compression chamber 27 during the swift connecting and disconnecting movements develop opposing forces that dampen these movements at the end of their respective stroke.

The separation place 12 to which the gas flow is directed is not necessarily adjacent to the fixed contacts as in these drawings, but can be present at any location between the fixed contacts and the mobile contacts at the open position, in which the arc could be present.

While the detailed description concerned an earthing switch, the invention could be implemented in other kinds of electric switches.

There is no condition on the gas filling the housing, which may be an insulating gas like SF6 or not.

The invention claimed is:

1. An electric switch comprising:

at least one fixed contact;

at least one mobile contact sliding in front of the fixed contact in a movement direction between a closed position at which the at least one mobile contact is joined with the fixed contact, and an open position at which the at least one mobile contact is separated from the fixed contact;

at least one blowpipe adjacent to the at least one fixed contact and extending on only one side of and at a short distance above the at least one mobile contact and parallel to the movement direction, the at least one blowpipe comprising a nozzle at a front end, the nozzle being directed towards a place at which the at least one mobile contact separates from the at least one fixed contact and being arranged to blow an arc in only one direction substantially perpendicular to the arc, and a piston at a rear end; and a mobile enclosure connected to the at least one mobile contact and sliding around the at least one blowpipe and around the piston, a compression chamber, which communicates with the nozzle, being defined by the mobile enclosure, the piston and the at least one blowpipe.

2. The electric switch according to claim 1, wherein the compression chamber comprises a valve that opens at a negative pressure of less than 1 bar inside the compression chamber.

3. The electric switch according to claim 2, wherein the valve is provided on the piston.

4. The electric switch according to claim 1, wherein the piston has an elongated shape, and the mobile enclosure has a corresponding elongated cross-section.

5. The electric switch according to claim 4, further comprising a plurality of the at least one fixed contact and the at least one mobile contact, the at least one mobile contact being mobile together, and a plurality of the at least one blowpipe, each of the plurality of the at least one blowpipe being associated to a respective one of the at least one fixed contact and of the at least one mobile contact, wherein the piston is single and common to all the plurality of the at least one blowpipe, and wherein the mobile enclosure is also single.

6. The electric switch according to claim 5, wherein the plurality of the at least one blowpipe are arranged in a row along the piston, and the at least one fixed contacts and the at least one mobile contact are arranged in rows parallel to the row of the plurality of the at least one blowpipe.

7. The electric switch according to claim 1, wherein the mobile enclosure is fastened to a carriage that also displaces the at least one mobile contact.

8. The electric switch according to claim 7, wherein the carriage comprises at least one axis connected to a near part of the at least one mobile contact.

9. The electric switch according to claim 8, wherein the at least one axis extends through a longitudinal slot made through a contact unit surrounding the at least one mobile contact, and the carriage is supported by the contact unit.

10. The electric switch according to claim 1, wherein the mobile enclosure and the at least one blowpipe are both arranged with overlaps with the at least one mobile contact along the movement direction.

11. The electric switch according to claim 1, wherein the mobile enclosure comprises at least one opening at a front face, through which the at least one blowpipe extends.

12. The electric switch according to claim 1, wherein the piston and the mobile enclosure are located aside the at least one mobile contact with respect to a longitudinal direction of the at least one mobile contact, without being in extension of the at least one mobile contact in the longitudinal direction.

13. The electric switch according to claim 1, wherein the at least one blowpipe has a wall provided with openings just before the piston.

* * * * *